US010519676B2

(12) United States Patent
Pervan

(10) Patent No.: US 10,519,676 B2
(45) Date of Patent: Dec. 31, 2019

(54) MECHANICAL LOCKING SYSTEM FOR FLOOR PANELS

(71) Applicant: CERALOC INNOVATION AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 15/603,913

(22) Filed: May 24, 2017

(65) Prior Publication Data

US 2017/0254096 A1 Sep. 7, 2017

Related U.S. Application Data

(63) Continuation of application No. 13/544,281, filed on Jul. 9, 2012, now Pat. No. 9,725,912.
(Continued)

(51) Int. Cl.
*E04F 15/02* (2006.01)
*E04F 15/10* (2006.01)

(52) U.S. Cl.
CPC ..... *E04F 15/107* (2013.01); *E04F 15/02038* (2013.01); *E04F 2201/0169* (2013.01); *E04F 2201/0547* (2013.01)

(58) Field of Classification Search
CPC ..... E04F 15/02016; E04F 15/02038; E04F 15/107; E04F 2201/01; E04F 2201/0107; E04F 2201/0115; E04F 2201/0123; E04F 2201/013; E04F 2201/0138; E04F 2201/0146; E04F 2201/0153;
(Continued)

(56) References Cited

U.S. PATENT DOCUMENTS 87,853 A 3/1869 Kappes
108,068 A 10/1870 Utley
(Continued)

FOREIGN PATENT DOCUMENTS

CA 2456513 A1 2/2003
CA 2 501 898 A1 11/2005
(Continued)

OTHER PUBLICATIONS

U.S. Appl. No. 13/670,039, Darko Pervan, filed Nov. 6, 2012 (Cited herein as US Patent Application Publication No. 2013/0081349 A1 of Apr. 4, 2013).
(Continued)

*Primary Examiner* — Kyle J. Walraed-Sullivan
(74) *Attorney, Agent, or Firm* — Buchanan Ingersoll & Rooney P.C.

(57) ABSTRACT

Floor panels are shown, which are provided with a vertical folding locking system on short edges that only locks vertically and a mechanical locking system on long edges that prevents displacement along the long edges. A locking system for primarily rectangular floor panels with long and short edges installed in parallel rows, which allows that the short edges may be locked to each other with a vertical movement without a horizontal connection and that such horizontal connection is accomplished by the locking system on the long edges including a first and second horizontal locking perpendicular to the edges and along the edges.

16 Claims, 9 Drawing Sheets

Related U.S. Application Data

(60) Provisional application No. 61/506,282, filed on Jul. 11, 2011.

(58) Field of Classification Search

CPC ..... E04F 2201/0161; E04F 2201/0169; E04F 2201/0176; E04F 2201/0184; E04F 2201/0192; E04F 2201/02; E04F 2201/021; E04F 2201/022; E04F 2201/023; E04F 2201/025; E04F 2201/026; E04F 2201/027; E04F 2201/028; E04F 2201/03; E04F 2201/035; E04F 2201/041; E04F 2201/042; E04F 2201/0547; E04F 2201/0552; E04F 2201/0558

USPC ..... 52/588.1, 582.1, 586.1, 586.2, 589.1, 52/591.1

See application file for complete search history.

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A * 6/1931 Rockwell ..... E04F 15/02 52/396.09
1,902,716 A 3/1933 Newton
2,026,511 A 12/1935 Storm
2,027,292 A 1/1936 Rockwell
2,110,728 A 3/1938 Hoggatt
2,204,675 A 6/1940 Grunert
2,266,464 A 12/1941 Kraft
2,277,758 A 3/1942 Hawkins
2,430,200 A * 11/1947 Wilson ..... E04F 13/10 52/588.1
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worsen
3,077,703 A 2/1963 Bergstrom
3,099,110 A 7/1963 Spaight
3,147,522 A 9/1964 Schumm
3,172,237 A 3/1965 Bradley
3,187,612 A 6/1965 Hervey
3,271,787 A 9/1966 Clary
3,276,797 A 10/1966 Humes, Jr.
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,626,822 A 12/1971 Koster
3,640,191 A * 2/1972 Hendrich ..... E04B 1/6125 404/41
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,764,767 A 10/1973 Randolph
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,767 A 2/1977 Colledge
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A * 9/1978 Hansen, Sr. ..... F16B 21/20 403/329
4,154,041 A 5/1979 Namy
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,622,784 A 11/1986 Black
4,648,165 A 3/1987 Whitehorne
4,819,932 A 4/1989 Trotter, Jr.
4,948,716 A 8/1990 Mihayashi et al.
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A * 2/2000 Andersson ..... E04B 1/6133 52/592.1
6,052,960 A 4/2000 Yonemura
6,065,262 A 5/2000 Motta
6,164,618 A 12/2000 Yonemura
6,173,548 B1 1/2001 Hamar et al.
6,182,410 B1 2/2001 Pervan
6,203,653 B1 3/2001 Seidner
6,210,512 B1 4/2001 Jones
6,254,301 B1 7/2001 Hatch
6,295,779 B1 10/2001 Canfield

(56) References Cited

U.S. PATENT DOCUMENTS 6,314,701 B1 * 11/2001 Meyerson ..... E04C 2/292 52/309.9
6,324,809 B1 * 12/2001 Nelson ..... E04F 15/02 52/309.14
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 * 1/2003 Hannig ..... B27F 1/04 52/582.1
6,546,691 B2 4/2003 Leopolder
6,553,724 B1 4/2003 Bigler
6,576,079 B1 6/2003 Kai
6,584,747 B2 7/2003 Kettler et al.
6,588,166 B2 7/2003 Martensson
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 * 12/2003 Andersson ..... E04F 15/02 428/48
6,672,030 B2 1/2004 Schulte
6,681,820 B2 1/2004 Olofsson
6,682,254 B1 * 1/2004 Olofsson ..... E04B 1/6125 403/375
6,684,592 B2 2/2004 Martin
6,685,391 B1 2/2004 Gideon
6,729,091 B1 5/2004 Martensson
6,763,643 B1 7/2004 Martensson
6,766,622 B1 * 7/2004 Thiers ..... E04F 15/04 52/591.3
6,769,219 B2 8/2004 Schwitte
6,769,835 B2 8/2004 Stridsman
6,802,166 B1 10/2004 Durnberger
6,804,926 B1 10/2004 Eisermann
6,808,777 B2 10/2004 Andersson
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,156,383 B1 1/2007 Jacobs
7,188,456 B2 3/2007 Knauseder
7,219,392 B2 5/2007 Mullet et al.
7,251,916 B2 8/2007 Konzelmann
7,257,926 B1 8/2007 Kirby
7,337,588 B1 * 3/2008 Moebus ..... E04F 13/08 52/588.1
7,377,081 B2 5/2008 Ruhdorfer
7,380,383 B2 * 6/2008 Olofsson ..... E04B 1/6125 52/582.1
7,441,384 B2 * 10/2008 Miller ..... E04F 15/04 52/589.1
7,451,578 B2 11/2008 Hannig
7,454,875 B2 11/2008 Pervan et al.
7,516,588 B2 4/2009 Pervan
7,517,427 B2 4/2009 Sjoberg et al.
7,520,092 B2 4/2009 Showers et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,591,116 B2 9/2009 Thiers et al.
7,614,197 B2 11/2009 Nelson
7,617,651 B2 11/2009 Grafenauer
7,621,092 B2 11/2009 Groeke et al.
7,621,094 B2 * 11/2009 Moriau ..... B27F 1/06 52/588.1
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,748,176 B2 7/2010 Harding et al.
7,757,452 B2 7/2010 Pervan
7,802,411 B2 9/2010 Pervan
7,806,624 B2 10/2010 McLean et al.
7,827,749 B2 * 11/2010 Groeke ..... B44C 5/043 52/316
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,913,471 B2 * 3/2011 Pervan ..... E04F 15/02 52/590.2
7,930,862 B2 4/2011 Bergelin et al.
7,954,295 B2 6/2011 Pervan
7,980,039 B2 7/2011 Groeke
7,980,041 B2 7/2011 Pervan
8,001,741 B2 * 8/2011 Duernberger ..... E04F 15/02 52/582.1
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 * 5/2012 Pervan ..... E04F 15/02 52/592.2
8,181,416 B2 5/2012 Pervan et al.
8,191,334 B2 6/2012 Braun
8,220,217 B2 7/2012 Muehlebach
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,375,673 B2 2/2013 Evjen
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 * 8/2013 Boo ..... B27F 1/02 52/582.1
8,511,031 B2 8/2013 Bergelin et al.
8,522,505 B2 9/2013 Beach
8,528,289 B2 9/2013 Pervan et al.
8,544,230 B2 10/2013 Pervan
8,544,233 B2 * 10/2013 Palsson ..... E04F 15/02 52/588.1
8,544,234 B2 10/2013 Pervan et al.
8,572,922 B2 11/2013 Pervan
8,578,675 B2 11/2013 Palsson et al.
8,590,250 B2 11/2013 Oh
8,596,013 B2 12/2013 Boo

(56) References Cited

U.S. PATENT DOCUMENTS 8,615,952 B2 12/2013 Engström
8,627,862 B2 1/2014 Pervan et al.
8,631,623 B2 1/2014 Engström
8,635,829 B2 1/2014 Schulte
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,806,832 B2 * 8/2014 Kell ..... E04F 15/02033 52/588.1
8,833,026 B2 9/2014 Devos et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
8,973,331 B2 3/2015 Boo
8,991,055 B2 3/2015 Cappelle
8,997,423 B2 4/2015 Mann
9,027,306 B2 5/2015 Pervan
9,051,738 B2 6/2015 Pervan et al.
9,068,360 B2 6/2015 Pervan
9,080,329 B2 7/2015 Döhring
9,091,077 B2 7/2015 Boo
9,103,128 B2 * 8/2015 Pomberger ..... E04F 13/08
9,151,062 B2 10/2015 Cappelle et al.
9,181,697 B2 11/2015 Masanek, Jr. et al.
9,194,134 B2 11/2015 Nygren et al.
9,206,611 B2 12/2015 Vermeulen et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,290,948 B2 3/2016 Cappelle
9,309,679 B2 4/2016 Pervan et al.
9,316,002 B2 4/2016 Boo
9,340,974 B2 * 5/2016 Pervan ..... B27F 1/08
9,347,227 B2 * 5/2016 Ramachandra ... E04F 15/02038
9,347,469 B2 5/2016 Pervan
9,359,774 B2 6/2016 Pervan
9,366,036 B2 6/2016 Pervan
9,371,654 B2 6/2016 Capelle
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,825 B2 * 1/2017 Ramachandra ..... E04F 15/105
9,540,826 B2 1/2017 Pervan et al.
9,663,940 B2 * 5/2017 Boo ..... E04F 15/02038
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,822,533 B2 11/2017 Huang
9,856,656 B2 1/2018 Pervan
9,874,027 B2 1/2018 Pervan
9,945,130 B2 4/2018 Nygren et al.
9,951,526 B2 4/2018 Boo et al.
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,458,125 B2 10/2019 Pervan
2001/0024707 A1 * 9/2001 Andersson ..... E04F 15/02 428/60
2001/0034991 A1 11/2001 Martensson
2001/0045150 A1 11/2001 Owens
2002/0014047 A1 2/2002 Thiers
2002/0031646 A1 3/2002 Chen et al.
2002/0069611 A1 6/2002 Leopolder
2002/0092263 A1 7/2002 Schulte
2002/0095894 A1 7/2002 Pervan
2002/0108343 A1 8/2002 Knauseder
2002/0170258 A1 11/2002 Schwitte
2002/0170259 A1 11/2002 Ferris
2002/0178674 A1 12/2002 Pervan
2002/0178680 A1 12/2002 Martensson
2002/0189190 A1 12/2002 Charmat et al.
2002/0189747 A1 * 12/2002 Steinwender ..... B27G 11/00 156/157
2002/0194807 A1 12/2002 Nelson et al.
2003/0009971 A1 * 1/2003 Palmberg ..... E04F 15/02 52/578
2003/0024199 A1 * 2/2003 Pervan ..... E04F 15/04 52/589.1
2003/0037504 A1 2/2003 Schwitte et al.
2003/0084636 A1 5/2003 Pervan
2003/0094230 A1 5/2003 Sjoberg
2003/0101674 A1 6/2003 Pervan
2003/0101681 A1 * 6/2003 Tychsen ..... E04F 15/02 52/783.1
2003/0145549 A1 8/2003 Palsson et al.
2003/0180091 A1 9/2003 Stridsman
2003/0188504 A1 10/2003 Eisermann
2003/0196405 A1 10/2003 Pervan
2004/0016196 A1 1/2004 Pervan
2004/0031225 A1 * 2/2004 Fowler ..... B32B 3/02 52/578
2004/0031227 A1 * 2/2004 Knauseder ..... E04F 13/0878 52/592.1
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0137180 A1 * 7/2004 Sjoberg ..... E04F 15/04 428/36.9
2004/0139676 A1 7/2004 Knauseder
2004/0139678 A1 7/2004 Pervan
2004/0159066 A1 8/2004 Thiers et al.
2004/0168392 A1 * 9/2004 Konzelmann ..... E04F 15/04 52/589.1
2004/0177584 A1 9/2004 Pervan
2004/0182033 A1 9/2004 Wernersson
2004/0182036 A1 * 9/2004 Sjoberg ..... E04F 15/02 52/592.1
2004/0200175 A1 10/2004 Weber
2004/0211143 A1 10/2004 Hannig
2004/0238001 A1 12/2004 Risden
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark

(56) References Cited

U.S. PATENT DOCUMENTS

2005/0210810 A1 9/2005 Pervan
2005/0235593 A1 10/2005 Hecht
2005/0252130 A1 11/2005 Martensson
2005/0252167 A1 11/2005 Van Horne, Jr.
2005/0268570 A2 12/2005 Pervan
2006/0053724 A1* 3/2006 Braun ..... C09J 5/00 52/578
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0185287 A1* 8/2006 Glazer ..... E04F 15/04 52/403.1
2006/0236642 A1 10/2006 Pervan
2006/0260254 A1* 11/2006 Pervan ..... E04F 15/02 52/592.1
2006/0272262 A1 12/2006 Pomberger
2007/0003366 A1* 1/2007 Wedberg ..... E21B 17/0426 403/410
2007/0006543 A1 1/2007 Engström
2007/0011981 A1 1/2007 Eiserman
2007/0028547 A1 2/2007 Grafenauer
2007/0065293 A1* 3/2007 Hannig ..... E04F 15/04 417/1
2007/0094969 A1* 5/2007 McIntosh ..... E04F 15/02044 52/386
2007/0094985 A1* 5/2007 Grafenauer ..... E04F 15/02 52/582.1
2007/0108679 A1 5/2007 Grothaus
2007/0113509 A1* 5/2007 Zhang ..... E04F 15/04 52/592.1
2007/0151189 A1* 7/2007 Yang ..... E04F 15/02 52/582.2
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1 8/2008 Alford
2008/0199676 A1* 8/2008 Bathelier ..... E04F 13/08 428/223
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0295438 A1* 12/2008 Knauseder ..... E04B 9/0435 52/589.1
2008/0302044 A1 12/2008 Johansson
2009/0019806 A1 1/2009 Muehlebach
2009/0049787 A1* 2/2009 Hannig ..... E04F 15/02038 52/589.1
2009/0064624 A1 3/2009 Sokol
2009/0100782 A1 4/2009 Groeke et al.
2009/0133353 A1 5/2009 Pervan et al.
2009/0151290 A1 6/2009 Liu
2009/0173032 A1 7/2009 Prager et al.
2009/0193741 A1 8/2009 Cappelle
2009/0193748 A1* 8/2009 Boo ..... B27F 1/02 52/589.1
2009/0193753 A1 8/2009 Schitter
2009/0217615 A1 9/2009 Engstrom
2009/0241460 A1 10/2009 Beaulieu
2009/0308014 A1 12/2009 Muehlebach
2010/0018149 A1* 1/2010 Thiers ..... E04F 15/02 52/588.1
2010/0043333 A1 2/2010 Hannig
2010/0083603 A1 4/2010 Goodwin
2010/0170189 A1 7/2010 Schulte
2010/0173122 A1 7/2010 Susnjara
2010/0218450 A1* 9/2010 Braun ..... E04F 15/02 52/588.1
2010/0275541 A1* 11/2010 Prinz ..... E01C 5/18 52/302.1
2010/0281803 A1 11/2010 Cappelle
2010/0293879 A1 11/2010 Pervan et al.
2010/0300029 A1 12/2010 Braun et al.
2010/0300031 A1 12/2010 Pervan et al.
2010/0313510 A1* 12/2010 Tang ..... E04F 15/02005 52/403.1
2010/0319290 A1 12/2010 Pervan
2010/0319291 A1* 12/2010 Pervan ..... E04F 15/02 52/588.1
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0094178 A1* 4/2011 Braun ..... E04F 15/02 52/588.1
2011/0131916 A1 6/2011 Chen
2011/0138722 A1* 6/2011 Hannig ..... E04F 15/02 52/309.1
2011/0154763 A1 6/2011 Bergelin et al.
2011/0162312 A1 7/2011 Schulte
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0247285 A1* 10/2011 Wybo ..... B29C 48/908 52/309.1
2011/0252733 A1 10/2011 Pervan
2011/0271631 A1 11/2011 Engstrom
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1 5/2012 Schulte et al.
2012/0151865 A1 6/2012 Pervan et al.
2012/0174515 A1 7/2012 Pervan
2012/0174519 A1 7/2012 Schulte
2012/0174520 A1 7/2012 Pervan
2012/0174521 A1 7/2012 Schulte et al.
2012/0192521 A1 8/2012 Schulte
2012/0222378 A1* 9/2012 Cappelle ..... E04F 15/02 52/309.1
2012/0240502 A1* 9/2012 Wilson ..... E04F 15/14 52/416
2012/0279161 A1 11/2012 Håkansson et al.
2012/0304590 A1 12/2012 Engström
2012/0324816 A1* 12/2012 Huang ..... E04F 15/02194 52/311.2
2013/0008117 A1 1/2013 Pervan
2013/0008118 A1* 1/2013 Baert ..... B29C 63/044 52/588.1
2013/0014463 A1 1/2013 Pervan
2013/0019555 A1 1/2013 Pervan
2013/0025231 A1 1/2013 Vermeulen

(56) References Cited

U.S. PATENT DOCUMENTS

2013/0025964 A1* 1/2013 Ramachandra ..... C08L 91/06 181/284
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan
2013/0152500 A1 6/2013 Engström
2013/0160391 A1 6/2013 Pervan et al.
2013/0167467 A1 7/2013 Vermeulen et al.
2013/0219806 A1 8/2013 Carrubba
2013/0232905 A2 9/2013 Pervan
2013/0239508 A1 9/2013 Pervan et al.
2013/0263454 A1 10/2013 Boo et al.
2013/0263547 A1* 10/2013 Boo ..... E04F 15/02038 52/588.1
2013/0283719 A1 10/2013 Döhring et al.
2013/0305650 A1* 11/2013 Liu ..... E04F 15/02038 52/592.1
2013/0309441 A1* 11/2013 Hannig ..... E04F 15/02038 428/100
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0130437 A1 5/2014 Cappelle
2014/0140766 A1* 5/2014 Riccobene ..... E01C 5/00 404/41
2014/0144096 A1 5/2014 Vermeulen et al.
2014/0150369 A1 6/2014 Hannig
2014/0186104 A1* 7/2014 Hamberger ..... E04F 13/0894 403/292
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0290173 A1 10/2014 Hamberger
2014/0305065 A1 10/2014 Pervan
2014/0338177 A1* 11/2014 Vermeulen ..... B27M 3/0066 29/429
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0047278 A1* 2/2015 Blount ..... E04F 15/08 52/223.6
2015/0047284 A1 2/2015 Cappelle
2015/0059281 A1 3/2015 Pervan
2015/0089896 A2 4/2015 Pervan et al.
2015/0113908 A1* 4/2015 Ramachandra ... E04F 15/02038 52/745.13
2015/0121796 A1 5/2015 Pervan
2015/0152644 A1 6/2015 Boo
2015/0167318 A1 6/2015 Pervan
2015/0176289 A1 6/2015 Hannig
2015/0176619 A1 6/2015 Baker
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0337542 A1 11/2015 Cappelle et al.
2016/0032596 A1 2/2016 Nygren et al.
2016/0060879 A1 3/2016 Pervan
2016/0069086 A1* 3/2016 Hullenkremer ... E04F 15/02011 52/588.1
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0160502 A1* 6/2016 Brousseau ..... E04C 2/205 52/309.4
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0237695 A1* 8/2016 Pervan ..... E04F 15/02038
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0289984 A1* 10/2016 Wagner ..... E04F 15/10
2016/0326751 A1 11/2016 Pervan
2016/0340913 A1 11/2016 Derelöv
2017/0030088 A1* 2/2017 Simoens ..... E04F 15/02038
2017/0037641 A1 2/2017 Nygren et al.
2017/0067261 A1* 3/2017 Hannig ..... E04F 15/02038
2017/0081860 A1 3/2017 Boo
2017/0321433 A1 11/2017 Pervan et al.
2017/0328072 A1* 11/2017 Hannig ..... E04F 15/02038
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0119431 A1 5/2018 Pervan et al.
2018/0155934 A1* 6/2018 D'Hondt ..... E04F 15/02038
2018/0178406 A1 6/2018 Fransson et al.
2018/0313094 A1* 11/2018 Pervan ..... E04F 15/02038
2019/0024387 A1 1/2019 Pervan et al.
2019/0048592 A1 2/2019 Boo
2019/0048596 A1 2/2019 Pervan
2019/0063076 A1 2/2019 Boo et al.
2019/0093370 A1 3/2019 Pervan et al.
2019/0169859 A1 6/2019 Pervan et al.
2019/0232473 A1 8/2019 Fransson et al.
2019/0271165 A1 9/2019 Boo

FOREIGN PATENT DOCUMENTS

CN 201588375 U 9/2010
CN 201110035241.6 * 1/2011 ..... E04F 15/02033
DE 138 992 C 7/1901
DE 142 293 C 7/1902
DE 2 159 042 6/1973
DE 25 05 489 A1 8/1976
DE 33 43 601 A1 6/1985
DE 33 43 601 C2 6/1985
DE 39 32 980 A1 11/1991
DE 42 15 273 A1 11/1993
DE 42 42 530 A1 6/1994
DE 196 01 322 A 5/1997
DE 299 22 649 U1 3/2000
DE 200 01 788 U1 6/2000
DE 200 02 744 U1 8/2000
DE 199 40 837 A1 11/2000
DE 199 58 225 A1 6/2001
DE 202 05 774 U1 8/2002
DE 203 20 799 U1 4/2005
DE 10 2004 055 951 A1 7/2005
DE 10 2004 001 363 A1 8/2005
DE 10 2005 002 297 A1 8/2005
DE 10 2004 054 368 A1 5/2006

(56) References Cited

FOREIGN PATENT DOCUMENTS

| | | | |
|---|---|---|---|
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| DE | 10 2009 041 297 | A1 | 3/2011 |
| EA | 1 650 375 | A8 | 9/2006 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 251 219 | A | 10/2002 |
| EP | 1 350 904 | A2 | 10/2003 |
| EP | 1 350 904 | A3 | 10/2003 |
| EP | 1 396 593 | A2 | 3/2004 |
| EP | 1 420 125 | A2 | 5/2004 |
| EP | 1 437 457 | A2 | 7/2004 |
| EP | 1 437 457 | A3 | 7/2004 |
| EP | 1 640 530 | A2 | 3/2006 |
| EP | 1 650 375 | A1 | 4/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| EP | 2 063 045 | A2 | 5/2009 |
| EP | 2 078 801 | A1 | 7/2009 |
| EP | 2 270 291 | A1 | 1/2011 |
| EP | 2 270 291 | B1 | 5/2011 |
| EP | 2 333 195 | A1 | 6/2011 |
| EP | 2 388 409 | A2 | 11/2011 |
| EP | 2 395 179 | A2 | 12/2011 |
| EP | 2 078 801 | B1 | 3/2012 |
| EP | 2 236 694 | A1 | 10/2012 |
| EP | 2 570 564 | A2 | 3/2013 |
| EP | 2 734 684 | A1 | 5/2014 |
| EP | 2 333 195 | B1 | 7/2014 |
| EP | 2 734 684 | B1 | 8/2016 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 2900115 | B2 | 6/1999 |
| JP | 2002-047782 | A | 2/2002 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2008/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/015669 | A3 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2008/116623 | A1 | 10/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/028621 | A1 | 3/2010 |
| WO | WO 2010/070472 | A2 | 6/2010 |
| WO | WO 2010/070472 | A3 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |

(56) References Cited

FOREIGN PATENT DOCUMENTS

| | | | |
|---|---|---|---|
| WO | WO 2011/001326 | A2 | 1/2011 |
| WO | WO 2011/012104 | A2 | 2/2011 |
| WO | WO 2011/012104 | A3 | 2/2011 |
| WO | WO 2011/012105 | A1 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/108812 | A2 | 9/2011 |
| WO | WO 2011/127981 | A1 | 10/2011 |
| WO | WO 2011/151758 | A2 | 12/2011 |
| WO | WO 2011/151758 | A3 | 12/2011 |
| WO | WO 2012/059093 | A2 | 5/2012 |
| WO | WO 2013/012386 | A1 | 1/2013 |
| WO | WO 2013/017574 | A1 | 2/2013 |
| WO | WO 2013/017575 | A1 | 2/2013 |
| WO | WO 2013/025163 | A1 | 2/2013 |
| WO | WO 2013/025164 | A1 | 2/2013 |
| WO | WO 2013/032391 | A1 | 3/2013 |
| WO | WO 2013/083629 | A1 | 6/2013 |
| WO | WO 2013/087190 | A1 | 6/2013 |
| WO | WO 2013/151493 | A1 | 10/2013 |

OTHER PUBLICATIONS

U.S. Appl. No. 14/046,235, Darko Pervan, filed Oct. 4, 2013 (Cited herein as US Patent Application Publication No. 2014/0053497 A1 of Feb. 27, 2014).

U.S. Appl. No. 14/258,742, Darko Pervan, filed Apr. 22, 2014 (Cited herein as US Patent Application Publication No. 2014/0223852 A1 of Aug. 14, 2014).

U.S. Appl. No. 14/315,879, Christian Boo, filed Jun. 26, 2014 (Cited herein as US Patent Application Publication No. 2015/0000221 A1 of Jan. 1, 2015).

U.S. Appl. No. 14/503,780, Darko Pervan, filed Oct. 1, 2014 (Cited herein as US Patent Application Publication No. 2015/0013260 A1 of Jan. 15, 2015).

U.S. Appl. No. 14/597,578, Darko Pervan, filed Jan. 15, 2015 (Cited herein as US Patent Application Publication No. 2015/0121796 A1 of May 7, 2015).

U.S. Appl. No. 14/633,480, Darko Pervan, filed Feb. 27, 2015 (Cited herein as US Patent Application Publication No. 2015/0167318 A1 of Jun. 18, 2015).

U.S. Appl. No. 14/938,612, Darko Pervan, filed Nov. 11, 2015 (Cited herein as US Patent Application Publication No. 2016/0060879 A1 of Mar. 3, 2016).

U.S. Appl. No. 14/951,976, Darko Pervan, filed Nov. 25, 2015 (Cited herein as US Patent Application Publication No. 2016/0153200 A1 of Jun. 2, 2016).

U.S. Appl. No. 15/048,252, Darko Pervan, filed Feb. 19, 2016 (Cited herein as US Patent Application Publication No. 2016/0168866 A1 of Jun. 16, 2016).

U.S. Appl. No. 15/148,820, Darko Pervan, filed May 6, 2016 (Cited herein as US Patent Application Publication No. 2016/0251860 A1 of Sep. 1, 2016).

U.S. Appl. No. 15/160,311, Darko Pervan, filed May 20, 2016 (Cited herein as US Patent Application Publication No. 2016/0326751 A1 of Nov. 10, 2016).

U.S. Appl. No. 15/172,926, Darko Pervan, filed Jun. 3, 2016 (Cited herein as US Patent Application Publication No. 2016/0281368 A1 of Sep. 29, 2016).

U.S. Appl. No. 15/175,768, Darko Pervan, filed Jun. 7, 2016 (Cited herein as US Patent Application Publication No. 2016/0281370 A1 of Sep. 29, 2016).

U.S. Appl. No. 15/229,575, Peter Derelöv, filed Aug. 5, 2016 (Cited herein as US Patent Applicatian Publication No. 2016/0340913 A1 of Nov. 24, 2016).

U.S. Appl. No. 15/365,546, Christian Boo, filed Nov. 30, 2016 (Cited herein as US Patent Applicatian Publication No. 2017/0081860 A1 of Mar. 23, 2017).

International Search Report dated Oct. 1, 2012 in PCT/SE2012/050817, Swedish Patent Office, Stockholm, Sweden, 9 pages.

Extended European Search Report dated Apr. 30, 2015 in EP 12 811 602.7, European Patent Office, Munich, DE, 4 pages.

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.

Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.

Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.

Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.

Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.

Pervan, Darko (Author), Technical Disclosure entitled "VA069 Combi Tongue," IP com No. IPCOM000210866D, Sep. 13, 2011, IP.com Prior Art Database, 41 pages.

Pervan, Darko (Author), Technical Disclosure entitled "VA070 Strip Part," IP com No. IPCOM000210867D, Sep. 13, 2011, IP.com Prior Art Database, 43 pages.

Pervan, Darko (Author), Technical Disclosure entitled "VA071 Pull Lock," IP com No. IPCOM000210868D, Sep. 13, 2011, IP.com Prior Art Database, 22 pages.

Pervan, Darko (Author), Technical Disclosure entitled "VA073a Zip Loc," IP com No. IPCOM000210869D, Sep. 13, 2011, IP.com Prior Art Database, 36 pages.

LifeTips, "Laminate Flooring Tips," available at (http://flooring.lifetips.com/cat/61734/laminate-flooring-tips/index.html), 2000, 12 pages.

U.S. Appl. No. 16/224,951, Darko Pervan and Tony Pervan, filed Dec. 19, 2018.

U.S. Appl. No. 16/269,806, Darko Pervan and Tony Pervan, filed Feb. 7, 2019.

Pervan, Darko, et al., U.S. Appl. No. 16/224,951 entitled "Mechanical Locking System for Floor Panels," filed in the U.S. Patent and Trademark Office Dec. 19, 2018.

Pervan, Darko, et al., U.S. Appl. No. 16/269,806 entitled "Mechanical Locking System for Floor Panels," filed in the U.S. Patent and Trademark Office Feb. 7, 2019.

U.S. Appl. No. 15/896,571, Darko Pervan, Niclas Håkansson and Per Nygren, filed Feb. 14, 2018.

U.S. Appl. No. 16/143,610, Darko Pervan, filed Sep. 27, 2018.

U.S. Appl. No. 16/163,088, Darko Pervan, filed Oct. 17, 2018.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Pervan, Darko, et al., U.S. Appl. No. 15/896,571 entitled "Mechanical Locking of Floor Panels with a Flexible Tongue," filed in the U.S. Patent and Trademark Office Feb. 14, 2018.

(56) References Cited

OTHER PUBLICATIONS

Pervan, Darko, U.S. Appl. No. 16/143,610 entitled "Mechanical Locking System for Panels and Method of Installing Same," filed in the U.S. Patent and Trademark Office Sep. 27, 2018.
Pervan, Darko, U.S. Appl. No. 16/163,088 entitled "Mechanical Locking System for Floor Panels," filed in the U.S. Patent and Trademark Office Oct. 17, 2018.
U.S. Appl. No. 15/726,853, Darko Pervan, filed Oct. 6, 2017.
U.S. Appl. No. 15/813,855, Darko Pervan, filed Nov. 15, 2017.
U.S. Appl. No. 15/855,389, Darko Pervan and Tony Pervan, filed Dec. 27, 2017.
Pervan, Darko, U.S. Appl. No. 15/813,855 entitled "Mechanical Locking of Floor Panels with a Glued Tongue," filed in the U.S. Patent and Trademark Office Nov. 15, 2017.
Pervan, Darko, et al., U.S. Appl. No. 15/855,389 entitled "Mechanical Locking System for Floor Panels," filed in the U.S. Patent and Trademark Office Dec. 27, 2017.
U.S. Appl. No. 16/419,660, Christian Boo, filed May 22, 2019.
U.S. Appl. No. 16/439,827, Darko Pervan, filed Jun. 13, 2019.
Boo, Christian, U.S. Appl. No. 16/419,660 entitled "Building Panel With a Mechanical Locking System," filed in the U.S. Patent and Trademark Office on May 22, 2019.
Pervan, Darko, U.S. Appl. No. 16/439,827 entitled "Mechanical Locking of Floor Panels With Vertical Folding," filed in the U.S. Patent and Trademark Office on Jun. 13, 2019.
Extended European Search report dated Oct. 9, 2019 in EP 19183301. 1, European Patent Office, Munich, DE, 12 pages.
Pervan, Darko, U.S. Appl. No. 16/581,990 entitled "Mechanical Locking System for Floor Panels," filed in the U.S. Patent and Trademark Office on Sep. 25, 2019.

* cited by examiner

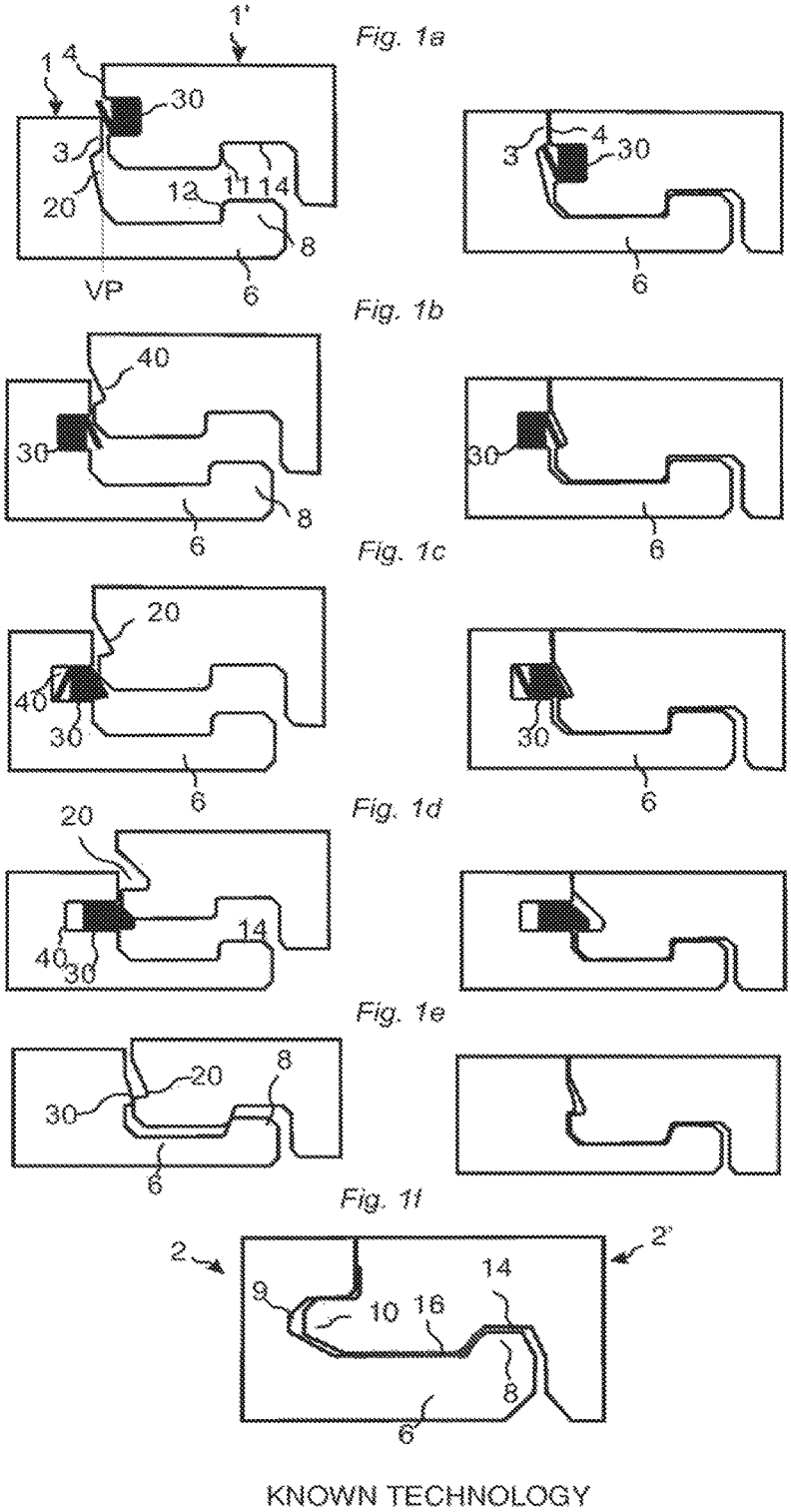
KNOWN TECHNOLOGY

MECHANICAL LOCKING SYSTEM FOR FLOOR PANELS

CROSS REFERENCE TO RELATED APPLICATION

This application is a continuation of U.S. application Ser. No. 13/544,281, filed on Jul. 9, 2012, which claims benefit of Provisional Application No. 61/506,282, filed Jul. 11, 2011. The entire contents of each of U.S. application Ser. No. 13/544,281 and Provisional Application No. 61/506,282 are hereby expressly incorporated by reference herein.

TECHNICAL FIELD

The disclosure generally relates to the field of mechanical locking systems for floor panels and building panels. Furthermore, floorboards, locking systems, installation methods and production methods are shown.

FIELD OF APPLICATION OF THE INVENTION

The present invention is particularly suitable for use in floating floors, which are formed of floor panels which are joined mechanically with a locking system integrated with the floor panel, i.e. mounted at the factory, are made up of one or more upper layers of veneer, decorative laminate or decorative plastic material, an intermediate core of wood-fibre-based material or plastic material and preferably a lower balancing layer on the rear side of the core. The following description of known technique, problems of known systems and objects and features of the invention will therefore, as a non-restrictive example, be aimed above all at this field of application and in particular at laminate flooring formed as rectangular floor panels with long and shorts edges intended to be mechanically joined to each other on both long and short edges. The long and short edges are mainly used to simplify the description of the invention. The panels may be square. It should be emphasized that the invention may be used in any floor panel and it may be combined with all types of known locking systems, where the floor panels are intended to be joined using a mechanical locking system connecting the panels in the horizontal and vertical directions on at least two adjacent sides. The invention may thus also be applicable to, for instance, powder based floors, solid wooden floors, parquet floors with a core of wood or wood-fibre-based material and a surface of wood or wood veneer and the like, floors with a printed and preferably also varnished surface, floors with a surface layer of plastic or cork, linoleum, rubber. Even floors with hard surfaces such as stone, tile and similar materials are included and floorings with soft wear layer, for instance needle felt glued to a board. The invention may also be used for joining building panels which preferably contain a board material for instance wall panels, ceilings, furniture components and similar.

BACKGROUND OF THE INVENTION

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface may comprise melamine-impregnated paper. The most common core material is fibreboard with high density and good stability usually called HDF—High Density Fibreboard. Sometimes also MDF—Medium Density Fibreboard—is used as core.

Traditional laminate floor panels of this type have been joined by means of glued tongue-and-groove joints.

In addition to such traditional floors, floor panels have been developed which do not require the use of glue and instead are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminium or HDF, which is integrated with the floor panel, i.e. joined with the floor panel in connection with the manufacture thereof.

The main advantages of floating floors with mechanical locking systems are that they are easy to install. They may also be disassembled and used once more at a different location.

However, there is still a need to improve the locking strength and to reduce the material costs.

Definition of Some Terms

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxta-posed upper parts of two adjacent joint edges of two joined floor panels together define a "vertical plane" perpendicular to the horizontal plane. By "vertical locking" is meant locking parallel to the vertical plane in D1 direction. By "horizontal locking" is meant locking parallel to the horizontal plane in D2 direction. By "first horizontal locking" is meant a horizontal locking perpendicular to the joint edges in D2 direction. By "second horizontal locking is meant a horizontal locking in the horizontal direction along the joint which prevents two panels to slide parallel to each other when they are laying in the same plane.

By "locking systems" are meant co acting connecting elements, which connect the floor panels vertically and/or horizontally. By "mechanical locking system" is meant that joining may take place without glue. Mechanical locking systems may also be joined by gluing. By "integrated with" means formed in one piece with the panel or factory connected to the panel.

By "up or upward" means toward the surface and by "down or downward" means toward the rear side. By "inwardly" is meant towards the centre of the floorboard and by "outwardly" means in the opposite direction.

By "carving" is meant a method to form a groove or a protrusion on an edge of a panel by carving a part of the edge to its final shape by one or several carving tool configurations comprising several non-rotating and fixed chip-removing surfaces located along the feeding direction.

Related Art and Problems Thereof

For mechanical joining of long edges as well as short edges in the vertical and in the first horizontal direction perpendicular to the edges several methods may be used. One of the most used methods is the angle-snap method. The long edges are installed by angling. The panel is then displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 2006/043893 (Välinge Innovation AB).

Several versions are used on the market as shown in FIGS. 1*a*-1*f*. FIGS. 1*a*, 1*b* show a flexible tongue 30 with a flexible snap tab extending from the edge. FIGS. 1*c*, 1*d* show a displaceable tongue with an inner flexible part that is bendable horizontally in a cross section of the tongue or along the joint. Such systems are referred to as vertical snap systems. The locking system may also be locked with a side push action such that a displaceable tongue 30 is pushed into a locked position from the long side edge when adjacent short side edges are folded down to the sub floor. FIG. 1*e* shows a fold down system with a flexible tongue 30 that is made in one piece with the core. FIG. 1*f* shows a long edge locking system in a fold down system that is connected with angling.

All such locking systems comprise a horizontal locking, which is accomplished by cooperating hook element in the form of a strip with a locking element cooperating with a locking groove.

Several versions of fold down systems are described in WO 2006/104436, WO 2007/015669, WO 2008/004960, WO 2010/087752 (Välinge Innovation AB) and the entire contents thereof are hereby expressly incorporated by reference and they constitute a part of this description.

Although such systems are very efficient, there is still room for improvements. It is difficult to insert the separate tongue 30 during production into a groove 40 over a strip 6 comprising a locking element 8. The locking groove 14 reduces the strength and the edges may crack. The protruding locking strip with the locking element causes a waste when the edges are machined and such waste may be considerable in wide tile-shaped floorboards.

It is a major advantage if the strip 6 is more compact and shorter and if the locking element 8 and the locking groove 14 are eliminated.

One of the main advantages with the fold down systems is that there is no requirement that the long edges should be displaceable. In fact it is an advantage if the long edges do not slide during angling since a flexible tongue that is used in some systems presses the short edges apart during folding.

WO 2006/043893 describes a fold down system with an essentially horizontal protruding strip that does not have a locking element. Such fold down system has no horizontal connection and the short edges may be locked by for example gluing or nailing to the sub floor. It would be an advantage if such floorboards could be installed in a floating manner.

Such a floating installation may be accomplished according to this disclosure with a locking system that comprises long edges that are locked in a first horizontal direction perpendicular to the edge and in a second horizontal direction along the edge. Long edges that are not displaced after locking will also keep the short edges together and prevent separation.

It is known that a separation of short edges of floor panels may be prevented with increased friction or with projections and spaces between the long edges that will counteract mutual displacements along the edge and consequently prevent the short edges to slide apart.

It is for example known from Wilson U.S. Pat. No. 2,430,200 that several projections and recesses between a tongue and a groove in a mechanical locking system may be used to prevent displacement along the joint. Such projections and recesses are difficult to produce, the panels can only be locked in well-defined positions against adjacent long edges and they cannot be displaced against each other in angled position when top edges are in contact.

Terbrack U.S. Pat. No. 4,426,820 describes an impractical locking system with a perfect fit in a panel made of plastic material. The perfect fit may prevent displacement along the joint.

WO 1994/026999 (Välinge Innovation AB) describes a mechanical locking system that locks vertically and horizontally and where a rubber strip or any other sealing device is applied in the groove or between the flat projection part of the strip and the adjacent panel edge as shown principally in FIG. 1*f*. A rubber strip may be used to increase friction along the joint.

WO 98/22677 (Golvabia) describes a tongue and groove joint where several different types of materials are used to increase friction in order to prevent the edges from sliding apart perpendicularly to the edge. Example of materials inserted or applied in the tongue and groove joint are flock, strip-shaped bands of rubber, plastic, foamed rubber adhesive coated surfaces in which friction-increasing material is fixed such as sand, plastic or rubber particles. Roughened or coarsened surfaces may also be used.

WO 03/025307 and WO 03/089736 (Välinge Innovation AB) describe that displacement along long edges may be counteracted or prevented by means of high friction, glue, mechanical means etc. and that the short edges may be formed merely with vertical locking means or completely without locking means. WO03/012224 (Välinge Innovation AB) describes that flexible elastic sealing compounds based on acrylic plastics, elastomers of synthetic rubber, polyurethane-based hot-melt adhesives, etc. may be applied between the horizontal locking surfaces in order to compensate moisture movements due to swelling or shrinking. Such elastically material will increase the friction and prevent displacement of long edges along the joint.

Wernersson WO 2004/083557 discloses floor panels with mechanical locking means wherein predetermined surfaces of the edges are provided with splines. There is no disclosure of the geometry of such mechanical locking means, how such splines are formed and on which surfaces they are applied.

WO 2006/123988 (Välinge Innovation AB) describes a panel with a slide locking system comprises a plurality of small local protrusions that prevents displacement along the joint edges when the panels are laying flat on the sub floor. The protrusions may lock against a flexible rubber material at the adjacent panel. The short edges are provided only with a vertical locking comprising a tongue made in one piece with the core. The panels may be locked with vertical folding and the slide lock prevents sliding along the joint after folding. A folding system at the short edges that only locks vertically and which comprise a flexible separate tongue is not described.

These known technologies to prevent displacement along the long edges suffer from several disadvantages. Friction created by pressure and small hard materials is not reliable since swelling and shrinking in wood fibre based panels may change the friction forces, thus the panels may as time goes slide and the short edges separate from each other. Friction material that is applied on surfaces that form active horizontal locking surfaces, such as the locking surfaces of the locking element and the locking groove and upper adjacent joint edges may change the locking geometry and prevent an easy installation.

SUMMARY

A first overall objective of the present invention is to provide a locking system for primarily rectangular floor panels with long and short edges installed in parallel rows, which allows that the short edges may be locked to each other with a vertical movement without a horizontal connection and that such horizontal connection is accomplished by the locking system on the long edges comprising a first and second horizontal locking perpendicular to the edges and along the edges.

The invention is based, in part, on the discovery that since displacement of the long edges is not needed in a fold down locking system, there is more freedom to design the long edges locking system.

The costs and functions should be favorable compared to known technology. A part of the overall objective is to improve the function and costs of those parts of the locking system that locks in the second horizontal direction along the joint when panels are installed on a sub floor.

More specifically the object is to provide a second horizontal locking system on the long edges, hereafter referred to as "slide lock" where one or several of the following advantages are obtained.

The slide lock on the long edges should be activated when a panel is brought in contact with an already installed panel and then angled down to the sub floor.

The slide lock function should be reliable over time and the panels should be possible to lock and unlock in any position when two adjacent long edges are brought into contact with each other.

The slide lock should be strong and prevent short edges of two locked panels from separating when humidity changes or when people walk on a floor.

The slide lock should be possible to lock with high precision and without the use of tools.

The locking system and the slide lock should be designed in such a way that the material and production costs are low and that flexible materials may be applied in a safe way without the risk that such separate materials will be included in the active locking surfaces in an uncontrolled way.

The invention is based on a general approach that the locking element and the locking groove at the long edges should be used to accomplish a horizontal locking perpendicular to the edge but also along the edge.

The above objects of the invention are achieved wholly or partly by locking systems, floor panels, and installation and production methods according to the disclosure herein. Embodiments of the invention are evident from the description and drawings.

A first aspect of the invention is a flooring system comprising a plurality of rectangular floor panels with short edges and long edges. The panels are adapted to be installed on a sub floor and connected to each other with a mechanical locking system for locking the panels vertically and horizontally. Said locking system comprising a tongue and a tongue groove for mechanically locking together adjacent edges vertical to the horizontal plane, thereby forming a vertical mechanical connection between the panels. A locking element at a first long edge and a locking groove at an opposite second long edge form a first horizontal mechanical connection between adjacent long edges locking the panels to each other in a direction parallel to the horizontal plane and at right angles to said adjacent long edges. The panels are provided with a short edge locking connection comprising a separate tongue for locking adjacent short edges in a first vertical direction, inserted in a fixation groove at a short edge of a panel. The tongue is preferably at least partly flexible and/or displaceable. The short edge locking connection further comprises a locking strip and a locking cavity for locking adjacent short edges in a second vertical direction. The short edge locking connection is configured to lock the adjacent edges in a vertical direction only. The long edges are provided with a second horizontal mechanical connection locking the panels to each other along said adjacent long edges, in a direction parallel to the horizontal plane and parallel to said adjacent long edges, when the panel are laying flat on the sub floor.

Said second horizontal mechanical connection at the long edges may comprises a locking element and locking groove with two sets of cooperating locking surfaces, wherein a first set is located closer to a vertical plane (VP) and the upper joint edges than a second set.

The two sets of locking surfaces may be inclined such that a lower part of the locking element is larger than an upper part.

The vertical extension of the second set of locking surfaces may be essentially the same or larger than the vertical extension of the first set of locking surfaces.

The long edge locking system may comprises a third set of cooperating locking surfaces located at the outer and lower part of the strip.

There may be a space between the upper part of the locking element and the locking groove.

Said second horizontal mechanical connection may comprise a flexible material which is applied in an essentially vertical groove.

Said second horizontal mechanical connection may comprise a flexible material, which is compressed horizontally in two opposite directions Said second horizontal mechanical connection may comprise a flexible material, which is located in an essentially vertical groove that is complementary with a wedge shaped locking element.

Said second horizontal mechanical connection may comprise a friction element located on the upper part of the locking element that cooperates with a friction groove.

The friction groove may comprise a flexible material.

Said second horizontal mechanical connection may comprise friction cavities located at the locking element.

Said second horizontal mechanical connection may comprise compressible material that is applied in the locking system at surfaces that do not comprise cooperative active locking surfaces that lock the panels vertically and horizontally.

The short edge locking connection may be locked with a vertical snap action where the separate tongue is displaced in the fixation groove during vertical displacement.

The short edge locking connection may be locked when the separate tongue is displaced in the fixation groove along the short edge.

According to a first preferred embodiment the locking system at the long edges comprises a locking element and locking groove with two sets of cooperating locking surfaces. A first set is located closer to a vertical plane and the upper joint edges than a second set. The locking surfaces are preferably inclined such that a lower part of the locking element is larger than an upper part. It is preferred that there is a space between the upper part of the locking element and the locking groove. Such a space may be used to give more production tolerances. Preferably, the vertical extension of the second set of locking surfaces is essentially the same or larger than the vertical extension of the first set of locking surfaces.

According to a second embodiment of the invention the long edge locking system comprises a flexible material located in a vertical groove that prevents displacement along the edges. The flexible material is preferably located between cooperating surfaces of the locking element and the locking groove.

According to a third embodiment of the invention the long edge locking system comprises at least three sets of cooperative locking surfaces between a locking element located on a strip and a locking groove. The first and the second sets are located in the upper part of the locking element wherein the first set is closer to the upper edges than the second set. The third set is located on the lower and outer part of the strip. This geometry is used to accomplish a strong press fit between the locking element and the locking groove and the panels will be tightly secured to each other such that displacement along the long edges and perpendicular to the short edges will be prevented.

Such a locking system with a press fit may be made much stronger than conventional locking systems with hooks at the short edges.

Said second mechanical connection may comprise a flexible tongue which is inserted in a fixation groove formed in the locking groove.

The above-described locking system at the long edges may also be used just individually to lock one pair of two adjacent edges, preferably the long edges, horizontally perpendicularly to the edges and along the edges. Such a locking system may be used together with many other types of locking systems at the other pair of adjacent edges, preferably the short edges, and may contribute to increase the horizontal locking strength at the short edges considerably. This is especially an advantage in large floors, with a length or width exceeding for example 20 m, and which are for example installed in commercial areas where the load on the floor may be considerable.

A second aspect of the invention is two floor panels provided with a locking system comprising a tongue and a tongue groove for mechanically locking together adjacent edges vertical to the horizontal plane, thereby forming a vertical mechanical connection between the panels. The locking system further comprises a first horizontal mechanical connection between adjacent edges for locking the panels to each other in a direction parallel to the horizontal plane and at right angles to said adjacent edges. The first horizontal mechanical connection comprises a locking element at a first edge and a locking groove at an opposite second edge. The tongue may be a separate tongue, preferably at least partly flexible and/or displaceable, inserted in a fixation groove at an edge of a panel. The locking system further comprises a second horizontal mechanical connection locking the panels to each other along said first and second edge, in a direction parallel to the horizontal plane and parallel to said adjacent edges, when the panels are laying flat on a sub floor.

The locking element and the locking groove preferably comprise two sets of cooperating locking surfaces, wherein a first set is located closer to a vertical plane (VP) and the upper joint edges than a second set.

At least one of the two sets of cooperating locking surfaces may comprise a flexible material. The flexible material may be a flexible tongue inserted in a fixation groove. The fixation groove may be formed in the locking groove.

The two sets of locking surfaces may be inclined such that a lower part of the locking element is larger than an upper part.

The vertical extension of the second set of locking surfaces may be essentially the same or larger than the vertical extension of the first set of locking surfaces.

The locking system may comprise a third set of cooperating locking surfaces located at the outer and lower part of the strip.

There may be a space between the upper part of the locking element and the locking groove.

Said second horizontal mechanical connection may comprise a flexible material, which is applied in an essentially vertical groove, said flexible material is preferably compressed horizontally in two opposite directions. The flexible material may be complementary with a wedge shaped locking element.

Said second horizontal mechanical connection may comprises a friction element located on the upper part of the locking element that cooperates with a friction groove.

The friction groove may comprise a flexible material.

Said second horizontal mechanical connection may comprise friction cavities located at the locking element.

Said second horizontal mechanical connection may comprise compressible material that is applied in the locking system at surfaces that do not comprise cooperative active locking surfaces that lock the panels vertically and horizontally.

The edges may be locked with a vertical snap action where the separate tongue is displaced in the fixation groove during vertical displacement.

The edges may be locked when the separate tongue is displaced in the fixation groove along the short edge.

BRIEF DESCRIPTION OF THE DRAWINGS

The disclosure will in the following be described in connection to exemplary embodiments and in greater detail with reference to the appended exemplary drawings, wherein:

FIGS. 1*a*-1*f* illustrate locking systems according to known technology.

DESCRIPTION OF EMBODIMENTS OF THE INVENTION

To facilitate understanding, several locking systems in the figures are shown schematically. It should be emphasized that improved or different functions may be achieved using combinations of the preferred embodiments.

The inventor has tested all known and especially all commercially used locking systems on the market that are installed with vertical folding in all type of floor panels, especially laminate and wood floorings and the conclusion is that at least all these known locking systems which have one or more locking elements cooperating with locking grooves may be adjusted to a system with a slide lock on the long edges which prevents displacement along the adjacent edges and with fold down locking system on short edges that only locks vertically.

The most preferable embodiments are however based on floorboards with a surface layer of laminate, powder based paper free surfaces or wood surfaces, a core of HDF or wood and a locking system on the long edge with a strip extending beyond the upper edge which allows locking by angling combined with a tongue and groove joint on the short edges comprising a separate tongue which preferably only locks vertically.

All embodiments may be used separately or in combinations. Angles, dimensions, rounded parts, spaces between surfaces, etc. are only examples and may be adjusted within the basic principles of the invention.

Figure 2A:
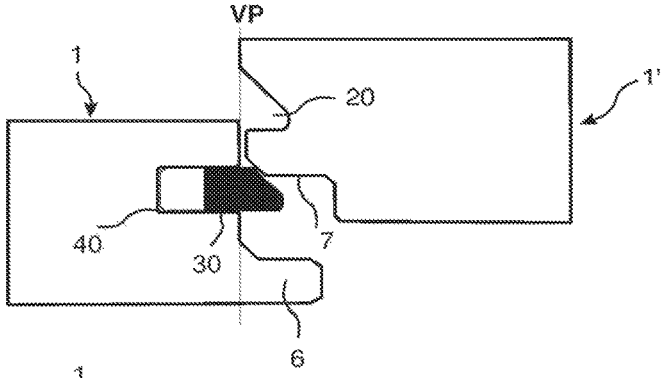
FIGS. 2*a*-2*d* illustrate a short edge locking system according to preferred embodiments of the invention.
Figure 2B:
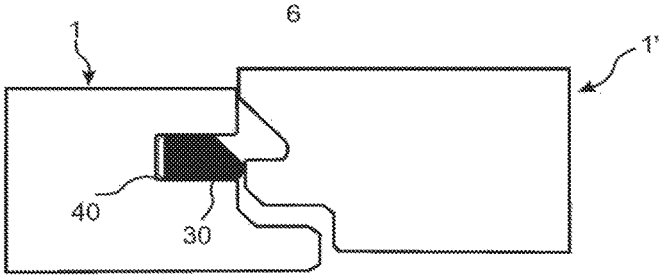
Figure 2C:
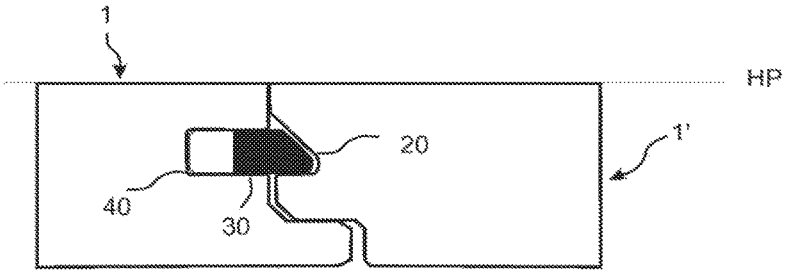
Figure 2D:
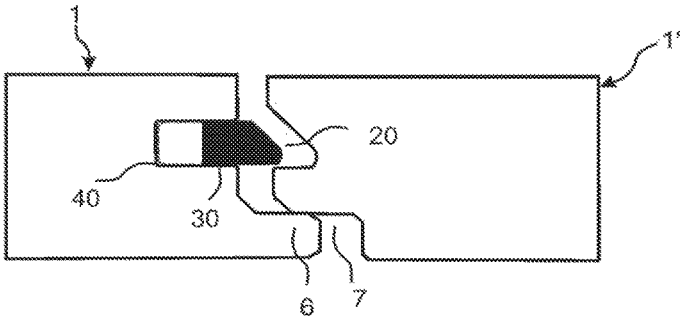

FIGS. 2*a*-2*d* show a first preferred embodiment of a short edge locking system provided with a flexible and displaceable tongue 30 in a first edge 1 inserted in a fixation groove 40 that cooperated with a tongue groove 20 in an adjacent second panel 1' and locks the panels in a first vertical direction according to known technology. The first panel 1 (strip panel) comprises a protruding strip 6 that extends outwardly beyond a vertical plane VP. The second panel 1' comprises a locking cavity 7 that cooperates with the locking strip 6 and locks the panels in a second vertical direction. FIG. 2*d* shows that the panels are only locked vertically and that they may be released or connected horizontally in essentially the same plane since there is no locking element on the strip and no hook connections in the locking system that prevents such horizontal displacement.

Such a locking system may be more cost efficient than convectional fold down systems since there is no need for a protruding strip with a locking element. Softer, thinner and less costly core materials may be used in a locking system that only is used for vertical locking. The horizontal locking may be obtained with a slide lock system at the long edges.

Figure 3A:
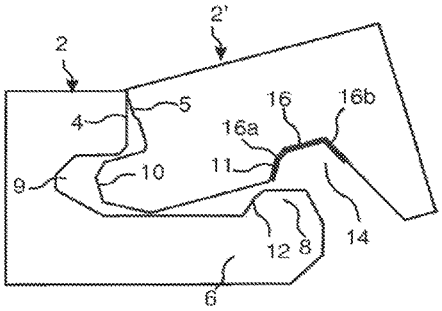
FIGS. 3*a*-3*f* illustrate a long edge locking system according to preferred embodiments of the invention.
Figure 3B:
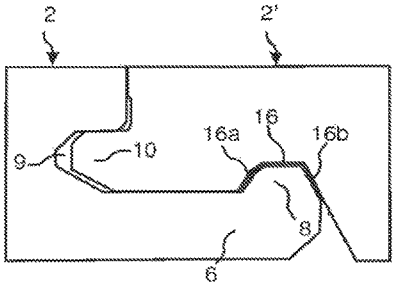

FIGS. 3*a* and 3*b* show a slide lock system according to one preferred embodiment comprising a tongue 10 and a tongue groove 9, a locking strip 6, a locking element 8 and a locking groove 14. A flexible and compressible material 16 such as synthetic or natural rubber or plastic foam is applied in the upper part of the locking groove 14 as a layer or in local spots, or on the upper part of the locking element 8. The upper part of the locking element 8 is formed such that preferably two horizontally opposite edges press against the compressible material 16*a*, 16*b*. In a wood floor with a lamella core, the locking element and the locking groove will be formed across the fibre orientation. The swelling and shrinking in the horizontal direction along the wood fibres is extremely small and will not cause any dimensional changes of the fitting tolerances between the locking element 8 and the locking groove 14. The counter pressure will not have any effect on the locking tolerances and swelling and shrinking of this part of the locking system will easily be compensated by the flexibility of the compressible material even in other wood based materials such as HDF, chipboard or plywood. It is preferred that the upper part of the locking element is wedge formed and that it cooperates with a complementary groove 14. It is preferred that the inner part of the groove 14 is smaller than the groove opening. This design may be used to create a friction connection even without compressible material.

Figure 3C:
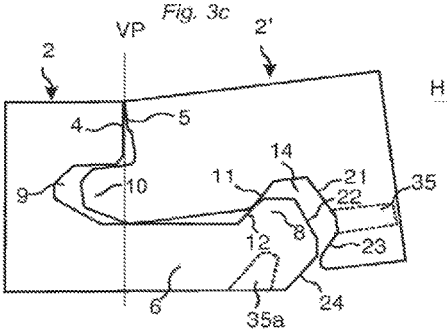
Figure 3D:
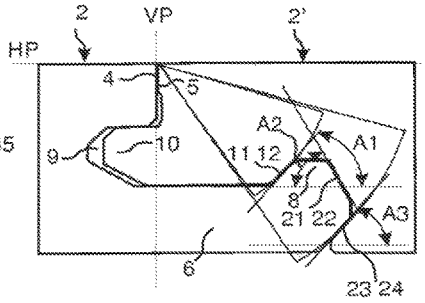

FIGS. 3*c* and 3*d* show a locking system with at least three sets of cooperative locking surfaces between the locking element 8 and the locking groove 14. The first 11,12 and the second 21,22 sets are located in the upper part of the locking element wherein the first set is closer to the upper edges 4,5 than the second set. The third set 23,24 is located, preferably below the first and the second sets, preferably on the lower and outer part of the strip 6. The locking surfaces are essentially flat but they may also be curved. The locking surfaces are preferably inclined. Preferably the angle A1 against a horizontal plane HP of the first set of cooperated surfaces should be slightly smaller than the angle A3 of the third set. This geometry may be used to accomplish an easy locking with angling and a strong press fit between the locking element 8 and the locking groove 14 and the panels will be tightly secured to each other such that displacement along the long edges and perpendicular to the short edges will be prevented. Preferably all or some of the cooperating sets of surfaces are made with angles A1, A2, A3 that are between 40-80 degrees against the horizontal plane or even more preferably between 45 and 75 degrees.

In wood cores, such as plywood or wood lamella core, it is preferred the fibre orientation is mainly perpendicular to the length direction of the edges. Layers in the plywood core may be adapted such that at least one set of cooperation surfaces comprises such fibre orientation that will provide a very high friction and a strong locking along the joint.

Such a locking system with a press fit with or without additional preferably flexible friction increasing materials between the locking element and the locking groove, may be made much stronger than conventional locking systems with hooks at the short edges. A horizontally extending groove 35 may be formed in a wall or the locking groove 14 in order to increase the flexibility of one of the locking surfaces 23 in the third set of locking surfaces. A similar mainly vertical groove 35*a* may also be formed in the strip 6. The forming may be made with rotating tools or carving tools.

The locking element and the locking groove may be formed in a very precise manner if high precision profiling is used where several tools are positioned at the same tool station such that the upper edge 4 and the locking element are formed at the same time in order to eliminate turning of the panels during machining. The locking groove and the upper edge 5 may be formed in the same way. The locking system may also be formed partly or completely with carving tools that allow forming of more complex geometries with undercuts.

The above described slide lock systems are preferably used on long edges and in combination with a fold down locking system on short edges as shown in FIGS. 2*a*-2*d*.

Figure 3E:
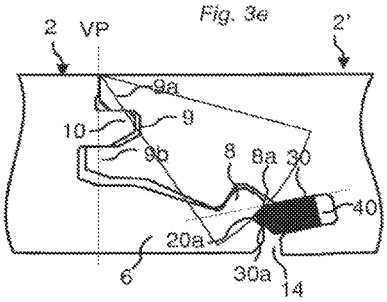
Figure 3F:
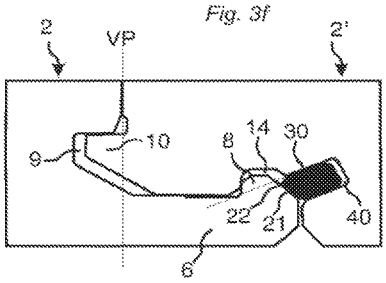

FIGS. 3*e* and 3*f* show that the flexible material may be combined with or replaced by with a flexible and preferable displaceable tongue 30 in one of the edges that is inserted in a fixation groove 40 and comprises a part, preferably an outer part, that is in contact with an adjacent edge and prevents displacement of the edges along the joint. The flexible tongue 30 is preferably inserted in a fixation groove 40 that is formed in the locking groove 14. The outer part of the tongue preferably comprises small and sharp locking protrusions that increase the longitudinal friction. The tongue may be fixed into the fixation groove 40 with friction and/or glue. One or several tongues 30 may be attached to one edge, preferably the long edge of a floor panel.

FIG. 3*e* shows a locking system comprising a tongue 10 and a strip on the same edge 2. This geometry saves material when the locking system is formed. The adjacent panel 2' comprises a tongue groove 9 with an upper 9*a* and a lower lip 9*b* that cooperates with the tongue 10 for vertical locking. The locking groove 14 comprises a fixation groove 40 that may be inclined in order to facilitate easy insertion of the flexible tongue 30 into the fixation groove 40. An outer sliding surface 30*a* of the flexible tongue 30 is during angling sliding against a siding surface 8*a* on the locking element and the flexible tongue is displaced inwardly and outwardly in the fixation groove. All types of tongues, which comprise at least one part that is flexible, may be used. The outer part of the flexible tongue may be wedge formed and may in locked position press with pre tension into the tongue groove 20*a*. The upper part of the tongue groove 20*a* is in this embodiment inclined upwards and outwardly such that the panels may be unlocked with an angling action.

The fixation groove may be formed in the outer part of the strip 6 and it is also possible the replace the flexible tongue 30 with a sharp nail made of for example plastic or metal, preferably aluminium.

FIG. 3*f* shows a locking system with a flexible tongue 30 that presses against an upper part 21 of the locking element 8. Such a locking system may have a flexible tongue that may is only be displaced with a distance of less than 0.5 mm. Even 0.1-0.2 mm may be sufficient to provide a locking.

All described embodiments may be combined. The slide lock system may also be combined with a conventional one piece tongue 10 and groove 9 system on the short edges. The flexible tongue may be designed such that it allows some displacement especially if a hammer and a tapping block is used. Two panels may also be connected with the short edges partly or completely and may thereafter be angled into a locked position at long edges.

The fixation groove may extend along the whole length or may be a local groove with a length that may be slightly longer than the length of the flexible tongue 30.

The slide lock system may also be used independently to lock panels at one pair of opposite edges and may be combined with any type of locking system at another pair of edges, preferably short edges. The slide lock system may be used to improve the overall locking of the panels and to increase the locking strengths at another pair of edges. This may be an advantage in thin panels or soft core material such as for example PVC where it is difficult to form large locking element. It is also suitable for narrow panels where the length of the locking element is rather small. Material savings may be obtained in for example a lamella core wood material where a separate, stronger and more expensive material usually is used at the short edges to form the strip and the locking element.

Figure 4A:
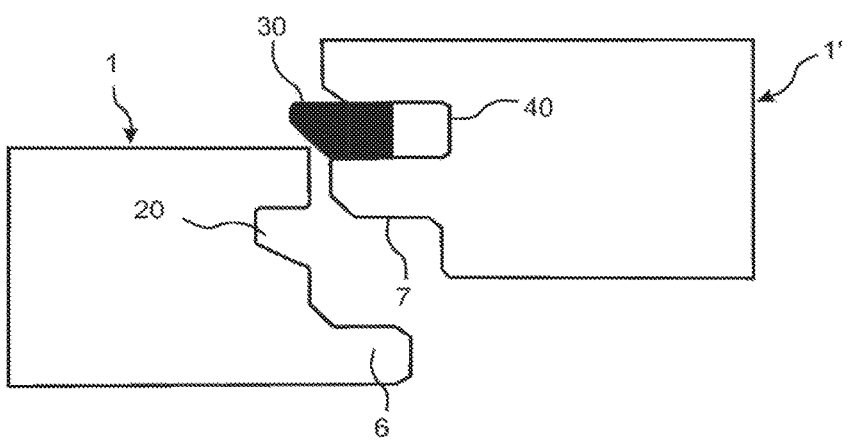
FIGS. 4*a*-4*c* illustrate a preferred embodiment of short edge locking system.
Figure 4B:
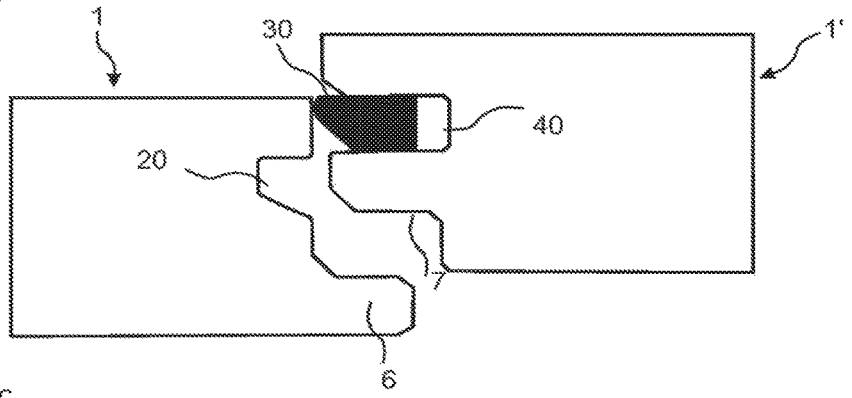
Figure 4C:
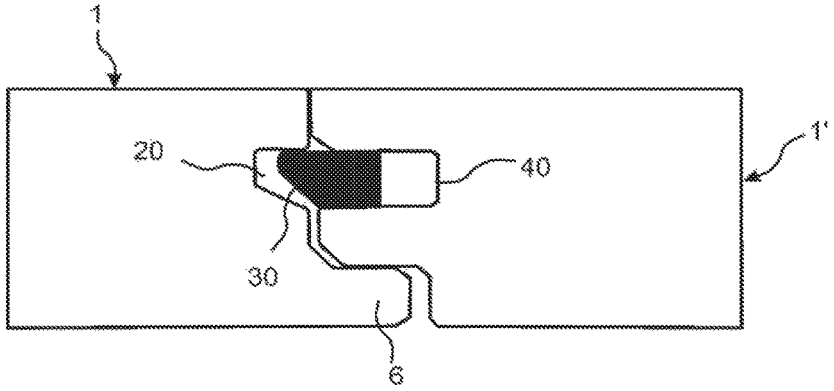

FIGS. 4*a*-4*c* show that the separate tongue may be attached to the fold panel 1'.

Figure 5A:
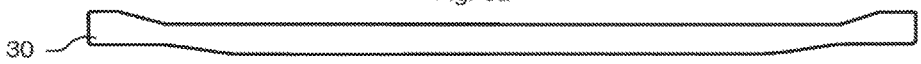
FIGS. 5*a*-5*f* illustrate exemplary separate tongues that may be used in to lock short edges.
Figure 5B:
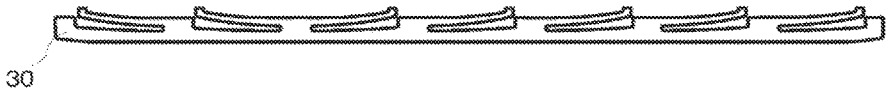
Figure 5C:
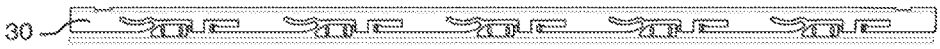
Figure 5D:
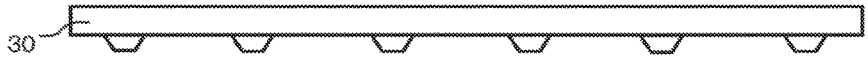

FIGS. 5*a*-5*d* show that all known tongues may be used in the short edge locking system. FIG. 5*a* shows a bow shaped tongue and FIG. 5*b* shows a bristle tongue. Such tongues are bended in length direction during locking. FIG. 5*c* shows a wedge tongue that is displaced with a side push action from the long edge such that it is displaced both along and perpendicular to the edge into the tongue groove 20. FIG. 5*d* shows as side push rigid tongue that is only displaced along the edge such that the protrusions on the tongue overlap the protrusions formed in the tongue groove 20.

Figure 5E:
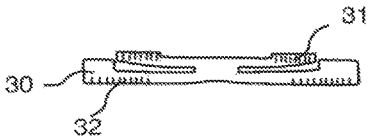

FIG. 5*e* shows a flexible tongue 30 that may be used to prevent displacement along the edge. The tongue comprises friction connections 31 that are located in the inner part of the fixation groove 40 and locking protrusion 32 that may be in contact with the adjacent edge, preferably an outer part of the locking element 8. Tongues as shown in FIGS. 5*a* and 5*b* may also be used.

Figure 5F:
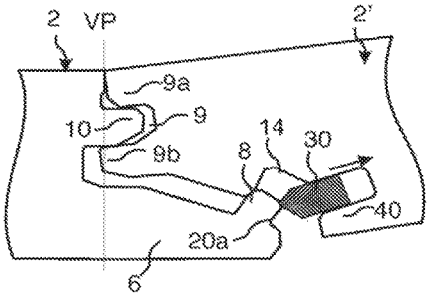

FIG. 5*f* shows a locking system that comprises a flexible tongue 30 and that is in a locking position whereby one of the edges 2' is angled to the sub floor. The flexible tongue 30 is in contact with the outer part of the strip when the locking element 8 and the locking groove 14 overlaps each other. This specific geometry prevents separation of the edges during angling.

Figure 6A:
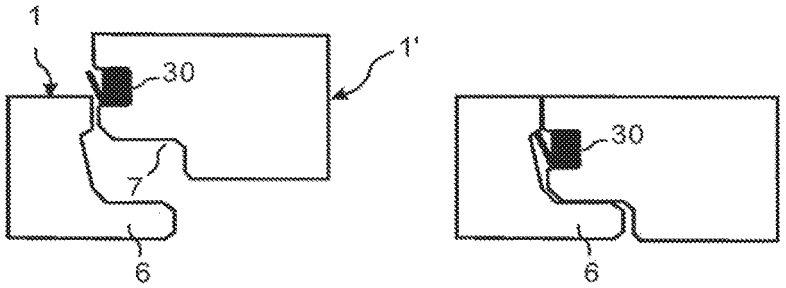
FIGS. 6*a*-6*f* illustrate preferred embodiments of the invention.
Figure 6B:
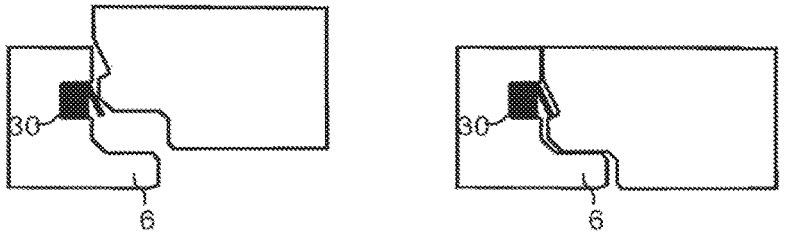
Figure 6C:
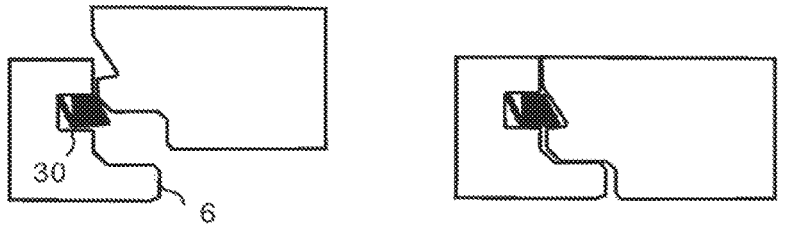
Figure 6D:
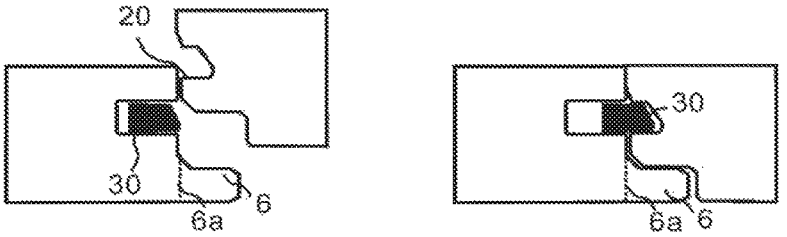
Figure 6E:
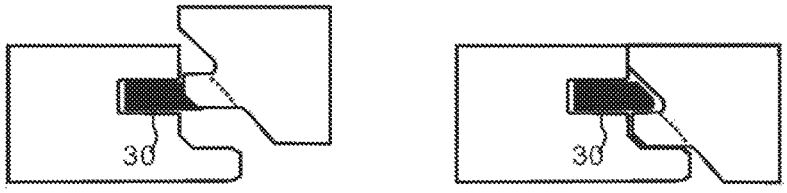
Figure 6F:
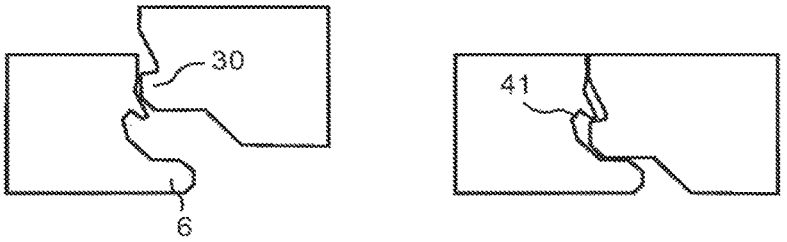

FIGS. 6*a*-6*f* show that all known fold down systems may be adapted to a locking system according to an embodiment of the invention by removing a part the locking element and preferably a part of the strip 6. This will provide cost savings due to less waste and a stronger joint. It is also possible to form a fold down system in very thin floorboards for example with a thickness of about 4-6 mm. FIG. 6*d* shows a side push system with a wedge shaped tongue and FIG. 6*e* shows a side push system with a tongue comprising protrusions. Even one-piece systems with a machined tongue as shown in FIG. 6*f* may be used. A short strip 6 provides a much easier machining of the undercut groove 41. This groove 41 may also be formed with carving FIG. 6*d* shows that all shown fold down locking systems may be adjusted such that the edge 6*a* may be formed without a protruding strip 6 and the tongue 30 may lock vertically upwards and downwards.

Figure 7A:
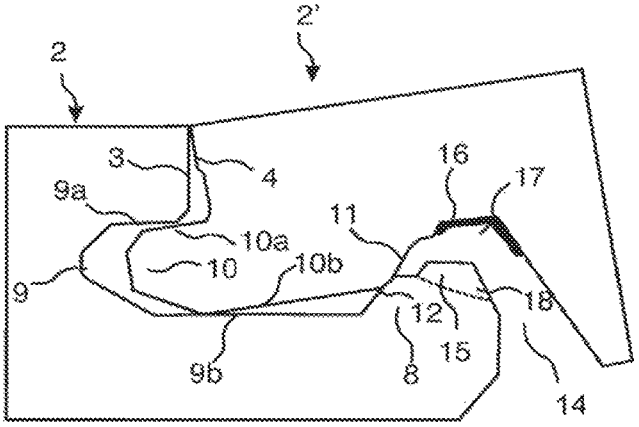
FIGS. 7*a*-7*c* illustrate a long edge locking system according to an embodiment of the invention.
Figure 7B:
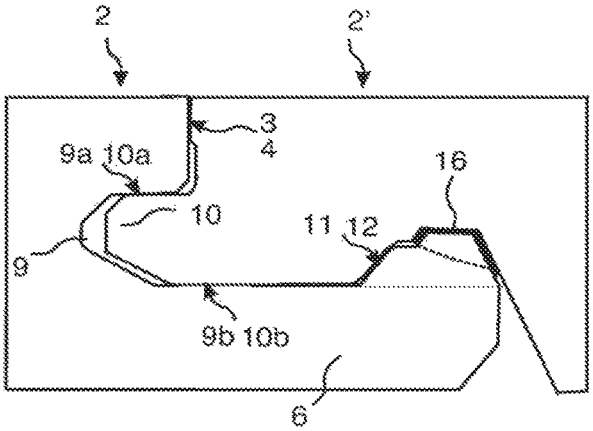

FIGS. 7*a*-7*b* show preferred embodiments. The long side locking system comprises a friction element 15, which in this embodiment is located on the upper part of the locking element 8, and that cooperates with a friction groove 17. One advantage is that no compressible material 16 is applied in the active locking surfaces 9*a*,9*b*,10*a*,10*b*,3,4,11,12 that lock the panels vertically and horizontally.

Figure 7C:
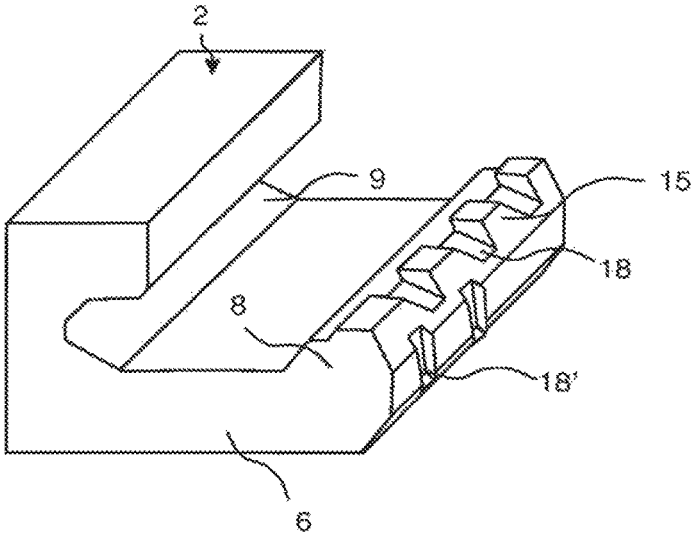

FIG. 7*c* shows that the friction may be improved if friction cavities 18 are formed on the upper part of the locking element 8 or in the friction element 15. Such cavities form expansion spaces for the flexible material 16 that may be applied with lower requirements on production tolerances. The cavities are preferably formed with a screw cutter as describe in WO2010/087752. Friction cavities 18' may also be formed on other parts of the locking system for example the outer part of the strip 6.

Figure 8A:
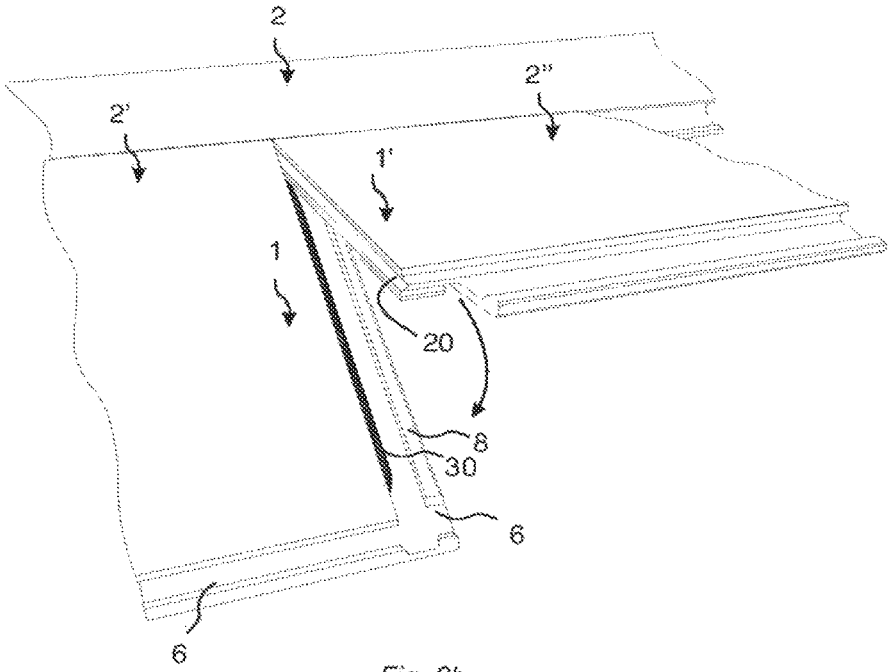
FIGS. 8*a*-8*b* illustrate vertical folding with a conventional locking system and a locking system according to an embodiment of the invention.
Figure 8B:
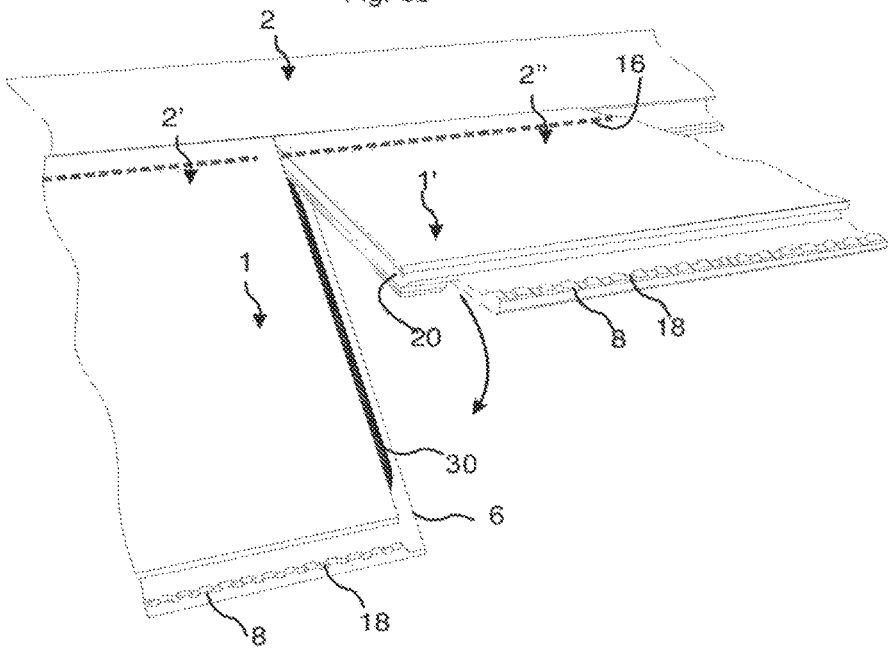

FIGS. 8*a* and 8*b* show that known locking systems, as shown in FIG. 8*a*, may easily be converted to a locking system according to an embodiment of the invention, as shown in FIG. 8*b*, and that the new locking system may be compatible with the old locking system. Friction cavities 18 are formed in the upper part of the locking element with a screw cutter, compressible material 16 is preferably inserted essentially in the groove along the whole long edge or in parts thereof and the locking element on the short edges is removed. A flexible tongue may also be inserted into the long edge as described above.

The panels are installed such that a long edge 2" of a new panel in a second row is put at an angle against a long edge 2 of a first panel installed in a previous row and displaced until its short edge 1' is in contact with a short edge 1 of a second panel installed in the second row. The new panel is angled down whereby the flexible tongue 30 locks the short edges 1,1' vertically. The long edges comprise a locking system with a friction connection that prevents displacement of the panels along the long edges 2,2',2".

Figure 9A:
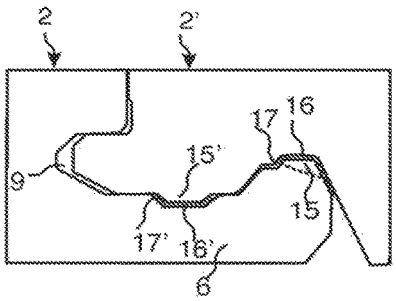
FIGS. 9*a*-9*d* illustrate preferred embodiments of the invention.

FIG. 9*a* shows that several friction elements 15,15' and friction grooves 17,17' with compressible material 16,16, may be provided.

Figure 9B:
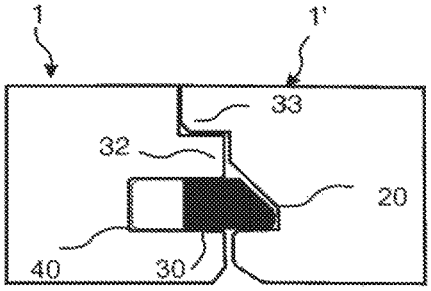

FIG. 9*b* shows that the protruding strip 6 at short edges may be replaced by overlapping upper edges 32, 33 above the separate tongue 30. It is of course possible to use both overlapping edges and a locking strip 6 cooperating with a locking cavity 7.

Figure 9C:
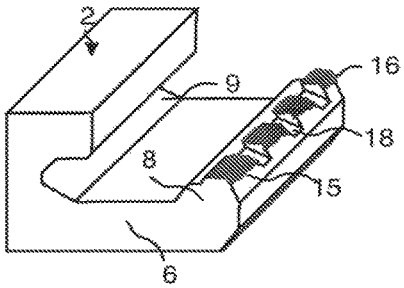

FIG. 9*c* shows that flexible and compressible material 16 may be applied on the friction element 15.

The long edge locking along the edge may be accomplished with a tight fit, with high friction or with all known methods to prevent displacement along the joint.

Wood floor with a lamella core that generally has a rough surface may be formed with a locking system with tight fit and with rather large cooperating locking surfaces. No flexible materials are needed to obtain sufficient friction. Such long side locking system is extremely difficult to displace, especially when the floor boards are long, for example 1.8-2.4 m and the friction force is generally sufficient to accomplish a locking which keeps the short edges together during the lifetime of the floor. Only a few small flexible tongues 30 may be provided at the long edges in order to give the necessary extra locking that may be needed in some applications and in very dry conditions when the wood material shrinks.

Figure 9D:
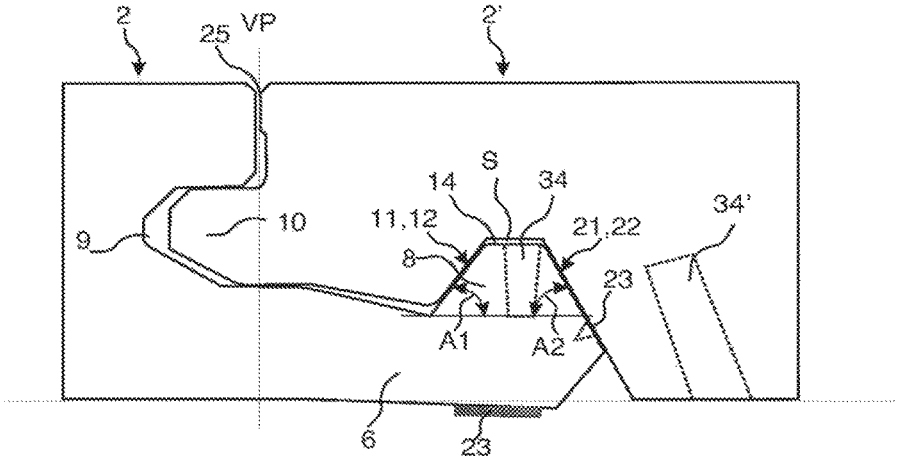

The locking strength of the slide lock may be increased considerably with a locking strip that is slightly bended and that causes a permanent vertical pressure as shown in FIG. 9*d*. Sufficient friction may be created even in HDF material that generally is formed with rather smooth surfaces. A strip 6 that in locked position is bended backwards will press the locking element 8 into the locking groove 14 when people walk on the floor or when furniture is applied on the surface. This will increase the locking strength of the second horizontal connection along the long edges. The locking strength may be increased further if for example a pressing protrusion 23 is formed on the lower part of the strip, preferably under the locking element. Such pressing protrusion 23 may be applied as a separate material on essentially the whole strip 6 or on separate parts along the edge.

Wedge shaped locking elements 8 that are pressed into a cooperating locking groove 14 as shown in FIG. 9*d* may create a sufficient friction even without a compressible friction material. FIG. 9*d* shows embodiment that comprises a locking element 8 and locking groove with two sets of cooperating locking surfaces. A first set 11,12 is located closer to the vertical plane than a second set 21,22. The locking surfaces are preferably inclined such that a lower part of the locking element is larger than an upper part. The locking surfaces may be essentially plane or curved. It is preferred that there is a space S between the upper part of the locking element and the locking groove. Such a space S may be used to give more production tolerances. The angle A1, A2 of the cooperating surfaces, or tangent line in case the surfaces are curved, should preferably be larger than about 45 degrees. Preferably the vertical extension of the second set 21,22 of locking surfaces is essentially the same or larger than the vertical extension of the first set 11,12 of locking surfaces. The second set should preferably extend downwards to a level, which is below the first set.

A flexing groove 34, 34' may be formed in the locking element 8 and/or behind the locking groove 14 in order to increase the flexibility of the walls of the locking element 8 or the locking groove 14. Such flexing groove may also be filled with a flexible material that increases the flexibility further.

A wedge shaped locking element as described above may be used to position the upper edges with a small play of for example of about 0.01-0.10 mm. Such a play will allow the top edges to swell and damages on the upper edges or squeaking sound will be eliminated. Such locking system is also very suitable to use in glue down floor installations or in combination with bevels between the upper joint edges.

The above-described embodiment may of course be combined with friction cavities 18 and flexible material 16 may be inserted between the locking element and the locking groove The locking system may be formed with two or more sets of locking elements and locking grooves in order to increase the friction. Small friction grooves 23 parallel with the joint edge may also increase the friction.

Glue or wax that cures after some time is also possible to use and may eliminate problems with shrinking and swelling of a pre tensioned locking system. Wax mixed with aluminium oxide particles, which are applied in the locking system, increases the friction considerably.

The long edge locking system may be used with all known vertical folding systems that lock the short edges vertically and horizontally.

The separate tongues are generally factory connected into an edge. Separate lose tongues that are inserted prior to folding or when two short edges are laying flat on the sub floor are not excluded.

The long edge locking system may be formed such that it is displaceable in an angle of 3-5 degrees. This facilitates installation around doors and similar.

The invention has been described above by way of example only and the skilled person will appreciate that various modifications may be made within the scope of the invention as defined by the appended claims.

The invention claimed is:

1. Floor panels provided with a locking system comprising a tongue and a tongue groove for mechanically locking together adjacent first and second edges vertically to a horizontal plane, thereby forming a vertical mechanical connection between the floor panels, the second edge being opposite to the first edge, the locking system further comprising a locking element at the first edge and a locking groove at the second edge forming a first horizontal mechanical connection between the adjacent first and second edges for locking the floor panels to each other in a direction parallel to the horizontal plane and at right angles to said first and second edges, wherein the first and second edges are provided with a second horizontal mechanical connection configured to lock the floor panels to each other along said first and second edges, in a direction parallel to the horizontal plane and parallel to said first and second edges, while the floor panels are locked in the direction parallel to the horizontal plane and at right angles to said first and second edges, and wherein the locking element and the locking groove comprise two sets of cooperating locking surfaces, a first set of the two sets of cooperating locking surfaces being located closer to a vertical plane and upper joint edges than a second set of the two sets of cooperating locking surfaces, and wherein said second horizontal mechanical connection comprises friction cavities located at the locking element, the friction cavities extending to an uppermost surface of the locking element.

2. The floor panels according to claim 1, wherein at least one of the two sets of cooperating locking surfaces comprises a flexible material.

3. The floor panels according to claim 2, wherein the flexible material is a flexible tongue inserted in a fixation groove.

4. The floor panels according to claim 3, wherein the fixation groove is formed in the locking groove.

5. The floor panels according to claim 1, wherein the two sets of cooperating locking surfaces are inclined such that a lower part of the locking element is wider than an upper part.

6. The floor panels according to claim 1, wherein a vertical extension of the second set of cooperating locking surfaces is the same or larger than a vertical extension of the first set of cooperating locking surfaces.

7. The floor panels according to claim 1, wherein the locking system further comprises a third set of cooperating locking surfaces located at an outer and lower part of a strip.

8. The floor panels according to claim 1, wherein there is a space between an upper part of the locking element and the locking groove in a locked state of the floor panels.

9. The floor panels according to claim 1, wherein said second horizontal mechanical connection comprises a flexible material, which is applied in a vertical groove.

10. The floor panels according to claim 9, wherein said flexible material is compressed horizontally in two opposite directions.

11. The floor panels according to claim 9, wherein the flexible material is complementary with a wedge shaped locking element.

12. The floor panels according to claim 1, wherein said second horizontal mechanical connection comprises a friction element located on an upper part of the locking element that is configured to cooperate with a friction groove.

13. The floor panels according to claim 12, wherein the friction groove comprises a flexible material.

14. The floor panels according to claim 1, wherein said second horizontal mechanical connection comprises a compressible material that is applied in the locking system at surfaces that do not comprise cooperative active locking surfaces configured to lock the floor panels vertically and horizontally.

15. The floor panels according to claim 1, wherein the first and second edges are configured to be locked with a vertical snap action where a separate tongue is displaced in a fixation groove during vertical displacement.

16. The floor panels according to claim 1, the floor panels comprising long edges and short edges, the long edges being longer than the short edges, wherein the first and second edges are configured to be locked when a separate tongue is displaced in a fixation groove along one of the short edges.

* * * * *